United States Patent [19]

Ohta et al.

[11] 4,229,523

[45] * Oct. 21, 1980

[54] METHOD OF UNDERCOATING TREATMENT OF POLYESTER FILMS FOR PHOTOGRAPHIC LIGHT-SENSITIVE MATERIALS

[75] Inventors: Hideyasu Ohta; Jun Shirasaki; Masaru Kanbe; Naoto Abe; Takahiro Uozumi; Masayoshi Mayama, all of Hino, Japan

[73] Assignee: Konishiroku Photo Industry Co., Ltd., Tokyo, Japan

[ * ] Notice: The portion of the term of this patent subsequent to Dec. 5, 1995, has been disclaimed.

[21] Appl. No.: 25,395

[22] Filed: Mar. 30, 1979

Related U.S. Application Data

[63] Continuation of Ser. No. 832,725, Sep. 12, 1977, abandoned, which is a continuation of Ser. No. 608,273, Aug. 27, 1975, abandoned.

[30] Foreign Application Priority Data

Aug. 31, 1974 [JP] Japan ..... 49-100445

[51] Int. Cl.[3] ..... G03C 1/78

[52] U.S. Cl. ..... 430/532; 427/40; 427/54.1; 428/483; 430/533

[58] Field of Search ..... 96/87 R; 427/40, 54; 430/532, 533; 428/483

[56] References Cited

U.S. PATENT DOCUMENTS 3,645,740 2/1972 Nishio et al. ..... 96/87 R

*Primary Examiner*—Jack P. Brammer

*Attorney, Agent, or Firm*—Bierman & Bierman

[57] ABSTRACT

A method of undercoating a polyester film of a light sensitive photographic material is disclosed in which one side of the film is pretreated such that the contact angle with water is below 58°. Additionally, a layer of an aqueous dispersion containing no organic solvent is applied to said side of said film, said dispersion containing a copolymer containing up to 60% by weight of glycidyl methacrylate and 25–60% by weight of ethyl acrylate.

7 Claims, No Drawings

METHOD OF UNDERCOATING TREATMENT OF POLYESTER FILMS FOR PHOTOGRAPHIC LIGHT-SENSITIVE MATERIALS

This is a Rule 60 continuation application of Ser. No. 832,725 filed on Sept. 12, 1977 now abandoned which is a continuation application of Ser. No. 608,273 filed Aug. 27, 1975 (now abandoned), and which claims the priority of Japanese Patent Application No. 100445/1974 filed on Aug. 31, 1974.

DETAILED DESCRIPTION OF THE INVENTION

This invention relates to a method of the undercoating treatment of polyester films for photographic light-sensitive materials. More particularly, the invention relates to a method of the undercoating treatment of a polyester film for improving the adhesion characteristic of the polyester film in forming a composite photographic light-sensitive material by coating a photographic light-sensitive layer on the polyester film, said method being characterized in that an aqueous dispersion of a copolymer comprising as main components glycidyl methacrylate and ethyl acrylate is used as an undercoating liquid to thereby improve the adhesion characteristic of the polyester film to the photographic light-sensitive layer, especially the resistance to the edge peeling.

Polyester films having excellent physical properties have recently been used instead of conventional cellulose type films as supports of photosensitive materials such as diazo type photosensitive materials and silver halide photographic light-sensitive materials. However, because of very high hydrophobic characteristic of polyester films no good adhesion can be obtained when hydrophilic materials such as photographic light-sensitive layers are laminated on such polyester films. Therefore polyester films is required to have a good adhesion under any of treatment conditions, and if this requirement is not satisfied, polyester films cannot be effectively used as photographic materials. In order to improve the adhesion characteristics of polyester films, various attempts have heretofore been made. For example, there has been adopted a method in which an undercoating liquid formed by dissolving a vinylidene terpolymer containing an acid component having an affinity with both a supporting film and a photographic light-sensitive layer, a polymer formed by grafting a butyl acrylate-styrene copolymer to gelatin or a butadiene polymer into an organic solvent such as ethylene chloride, dioxane, acetone and methyl alcohol and further in addition to the solution an organic solvent acting to the supporting film as a solvent or swelling such as chlorophenol and cresol to improve the adhesion between the supporting film and the photographic light-sensitive layer is coated on the supporting film.

This conventional method using the above-mentioned solvent type undercoating liquid is defective in that when the coated liquid is dried, vapors of organic solvents are generated and the vapored solvents cause environmental pollutions and operational troubles. Therefore, as a result, an expensive equipment system is needed for recovery of these organic solvent vapors. Expecially when solvents or swelling agents for polyester film supports are incorporated into the undercoating liquids, they not only release harmful vapors but also render polyester films non-transparent. Accordingly, these solvents or swelling agents often bring about such drawbacks as drastical reduction of the quality of the films, especially the damages of the surface.

As means for overcoming the above disadvantage, there has been proposed and practised a method in which a solvent type undercoating liquid free of a solvent or swelling agent for a polyester film support is coated before stretching of the supporting film or after monoaxial stretching but before biaxial stretching. In this method, since stretching is performed after the coating treatment, the peripheral portion of the film cannot practically be used and the loss is considerable, resulting in economical disadvantages.

In order to overcome the foregoing defects, various aqueous dispersions containing copolymers have now been used as undercoating liquids instead of the foregoing solvent type undercoating solutions. For example, the specification of U.S. Pat. No. 3,615,556 discloses a method comprising undercoating an aqueous dispersion containing a butadienestyrene copolymer including an acid component on a biaxially stretched polyester film. Further, the specifications of U.S. Pat. No. 2,627,088 and U.S. Pat. No. 2,698,240 disclose undercoating methods using an aqueous dispersion containing a vinylidene type copolymer including an acid component. Moreover, Japanese Patent Publications No. 13278/69 and No. 10988/70 disclose methods comprising undercoating an aqueous dispersion containing a copolymer of an alkyl acrylate with an aliphatic bifunctional monomer having two aryl or vinyl groups on a biaxially stretched polyester film. Thus, various attemps have now been made to overcome various troubles and disadvantages brought about when solvent type undercoating liquids are employed. However, it is very difficult to select kinds of aqueous dispersions and processing conditions so that a good adhesion will be attained by undercoating a copolymer-containing aqueous dispersion on a biaxially stretched polyester film having a high hydrophobic characteristics. Consequently a satisfactory adhesion can hardly be obtained. There has also been proposed a method in which the surface of a biaxially stretched hydrophobic polyester film is subjected to a hydrophilic treatment such as corona discharge or ultraviolet irradiation and then an undercoating liquid is coated on the treated surface. It is known that if this method is conducted by using an aqueous dispersion containing a copolymer as an undercoating liquid, the adhesion between a polyester film and a hydrophilic layer coated thereon can be improved. For example, as disclosed in Japanese Patent Application Laid-Open Specification No. 11118/74, a silver halide photographic light-sensitive material prepared by forming a silver halide emulsion layer on a polyester film support on which a copolymer-containing aqueous dispersion has been undercoated after a hydrophilic treatment such as mentioned above has a good adhesion just after preparation, during development and after development and drying. However, such silver halide photographic light-sensitive material including an undercoating layer of a copolymer-containing aqueous dispersion shows only unsatisfactory results with respect to prevention of a trouble having a great influence when development is carried out by using an automatic developing machine, namely occurrence of edge peeling. By the term "edge peeling" referred to herein is meant a phenomenon that when the edges of a silver halide photographic light-sensitive material being developed and kept in the swollen state are rubbed with a finger, a soft rubber piece or the like, the silver halide emulsion layer is peeled from the support. More specifically, as an instance of the trouble caused by edge peeling, there is mentioned an undesired phenomenon that when the silver halide photographic light-sensitive material is rubbed by a delivery rack or a rubber roll when it is developed by the use of an antomatic developing machine, peeling phenomenon is observed from edge portions and the quality is drastically reduced.

Apparent from the foregoing, there has not yet been developed an undercoating method which can provide a practically satisfactory adhesion when a photographic light-sensitive layer, especially a silver halide photographic light-sensitive layer, is formed on a polyester film.

It is therefore a primary object of this invention to provide an undercoating method according to which a good adhesion can be attained without release of a harmful organic solvent in forming a photographic light-sensitive material comprising a polyester film support, especially an undercoating method according to which a silver halide photographic light-sensitive material using a polyester film as a support in which occurrence of edge peeling is prevented is provided.

We have found that in preparing a photographic light-sensitive material including a polyester film as a support, when a polyester film is subjected to such a pre-treatment that the contact angle of the polyester film with water is below 58° and the polyester film is undercoated with an aqueous dispersion (hereinafter referred to as "aqueous copolymer dispersion of this invention") of a copolymer comprising 20 to 60% by weight of glycidyl methacrylate units and 25 to 60% by weight of ethyl acrylate units, the sum of said glycidyl methacrylate and ethyl acrylate units occupying at least 76% by weight of the copolymer, the foregoing object can be attained.

When a photographic light-sensitive material is prepared by forming a photographic light-sensitive material on a polyester film support which has been subjected to the hydrophilic treatment and coated with an aqueous copolymer dispersion of this invention containing a copolymer comprising as main components both of glycidyl methacrylate and ethyl acrylate, no organic solvent is released during the manufacturing process and a very excellent adhesion is attained. Especially, a silver halide photographic light-sensitive material obtained by forming a silver halide emulsion layer on the above support is meritorious in that no edge peeling is caused even when it is developed by using an automatic developing machine.

As the polyester film to be used in this invention, there can be mentioned, for example, polyethylene terephthalate films, polyethylene-2,6-naphthalate films and poly(cyclohexane-1,4-dimethanol terephthalic acid ester) films. The use of a biaxially stretched polyethylene terephthalate film is especially preferred.

The aqueous copolymer dispersion of this invention contains a copolymer comprising 20 to 60% by weight of glycidyl methacrylate units and 25 to 60% by weight of ethyl acrylate units, the sum of said glycidyl methacrylate and ethyl acrylate units occupying at least 76% by weight of the copolymer. This copolymer may further include an optional comonomer capable of copolymerizing with said monomer units. In the case of a copolymer, such as compounds 2 and 7 shown in Table 1 disclosed later, in which the content of ethyl acrylate units is higher than the content of glycidyl methacrylate units, it is preferred in order to prevent blocking in the undercoating layer, that a monomer capable of rendering the resulting copolymer relatively rigid, namely increasing the glass transition temperature in the resulting copolymer, such as vinylidene chloride, styrene, methyl methacrylate, ethyl methacrylate, butyl methacrylate, vinyl acetate, acrylonitrile and diacetone acrylamide be used as a copolymer component (comonomer). On the other hand, in the case of a copolymer such as compound 8 shown in the table, in which the content of ethyl acrylate units is lower than the content of glycidyl methacrylate units, it is preferred in order to prevent reduction of the adhesion of the undercoating layer that a monomer capable of reducing the glass transition temperature of the resulting copolymer, such as butyl acrylate, 2-ethylhexyl acrylate, isoprene and butadiene be used as a comonomer. Further, in the aqueous copolymer dispersion of this invention in order to improve the mechanical stability, for example, the stability to decomposition or deterioration of the dispersion by shocks at the agitation step, the copolymer may include up to 5% by weight of such a comonomer as acrylic acid, methacrylic acid, itaconic acid, 2-sulfoethyl methacrylate and 2-sulfopropyl methacrylate. In order to assure good anti-blocking and adhesion characteristics in the undercoating layers, especially to prevent occurrence of edge peeling, it is indispensable in this invention that the total content of the glycidyl methacrylate and ethyl acrylate units in the copolymer should be at least 50% by weight. The copolymer to be included in the aqueous copolymer dispersion of this invention is prepared, as detailed hereinafter, according to the emulsion polymerization process and it is generally obtained in the form of an aqueous dispersion of a finely divided emulsified polymer, namely a so-called latex. More specifically, an aqueous dispersion of a copolymer is prepared, for example, by adding comonomers dropwise to an aqueous solution containing an emulsifying dispersant such as ammonium persulfate and a polymerization promotor such as acidic sodium sulfite while the aqueous solution is maintained at about 60° C. under agitation in a flask equipped with a reflux cooler and an agitator. Best results are obtained when up to 5% by weight, especially up to 1% by weight based on the comonomers, of a surface active agent is used for the polymerization reaction. The particle size of the copolymer in the resulting dispersion is changed by synthesis conditions such as the amount used of the surface active agent, the agitation condition and the polymerization temperature, and in general, it is preferred that the particle size of the copolymer be about 0.15$\mu$. The copolymer is obtained in the form of an aqueous dispersion, and the so-prepared dispersion can be used directly as an undercoating liquid and if desired, a diluent, an organic solvent, a surface active agent or the like may be added to the dispersion to form an undercoating liquid.

Processes for preparing typical copolymers (illustrative compounds) to be contained in the aqueous copolymer dispersion of this invention and comparative copolymers (prepared according to the emulsion polymerization process as in the case of illustrative compounds and obtained in the form of an aqueous dispersion of a finely divided emulsified copolymer) will now be described.

PREPARATION EXAMPLE 1

Preparation of illustrative compounds 1 to 8 and Comparative Compounds 1 to 3 Shown in Table 1

A 500 ml-capacity, 4-neck flask equipped with an agitator, a reflux cooler, a temperature-adjustable heating device, a thermometer and a dropping funnel was charged with 200 ml of degasified distilled water and sodium dodecylbenzene-sulfonate as an emulsifying dispersant, and the charge was heated so as to maintain the inside of the flask at 60° C. and agitation was continued at a speed of 250 rotations per minute. Then, 0.15 g of ammonium persulfate as a polymerization initiator and 0.15 g of acidic sodium sulfite as a polymerization propmotor were added to the charge of the flask, and 1/10 of prescribed amounts of monomers shown in Table 1 were first added. When the polymerization was initiated, the addition of the monomers was interrupted for 10 minutes, and the remaining monomers were added dropwise at a constant speed over a period of 50 minutes. Since heat was violently generated during the dropwise addition of the monomers, cooling was conducted so that the inside temperature was always maintained at 60° C. Even after completion of the dropwise addition of the monomers, the reaction was continued for 4 hours under the same conditions to complete the polymerization substantially. Each of the so-prepared copolymers was obtained in the form of an aqueous dispersion of a finely divided emulsified polymer, in which the solid content was within a range of 32 to 33% by weight. The dispersion had a surface tension of 45 to 52 dyne/cm as measured at 25° C. and the degree of polymerization was higher than 96%. When the dispersion was observed under an electronic microscope, it was found that the particle size of the dispersed polymer was about 0.12μ. When epoxy group contents in respective copolymers were determined, it was found that in each of the copolymers, the epoxy content was 96 to 100% of the theoretical value calculated from the amount charged of glycidyl methacrylate. Thus, it was confirmed that hydrolysis of glycidyl methacrylate could be substantially neglected. The so-prepared copolymer dispersion had a pH of about 4, it was used after the pH was adjusted to 7 by addition of 1 N aqueous ammonia.

TABLE 1.

| Copolymer (Aqueous Dispersion) Obtained in Preparation Example 1 | Monomers Used for Preparation of Copolymer | Amounts Added (% by weight) of Monomers |
|---|---|---|
| Compound 1 | glycidyl methacrylate | 20 |
| | ethyl acrylate | 56 |
| | vinylidene chloride | 24 |
| Compound 2 | glycidyl methacrylate | 20 |
| | ethyl acrylate | 60 |
| | vinylidene chloride | 20 |
| Compound 3 | glycidyl methacrylate | 30 |
| | ethyl acrylate | 55 |
| | vinylidene chloride | 15 |
| Compound 4 | glycidyl methacrylate | 50 |
| | ethyl acrylate | 40 |
| | vinylidene chloride | 10 |
| Compound 5 | glycidyl methacrylate | 50 |
| | ethyl acrylate | 50 |
| Compound 6 | glycidyl methacrylate | 50 |
| | ethyl acrylate | 50 |
| | 3-sulfopropyl methacrylate | 0.5 |
| Compound 7 | glycidyl methacrylate | 30 |
| | ethyl acrylate | 50 |

TABLE 1-continued

| Copolymer (Aqueous Dispersion) Obtained in Preparation Example 1 | Monomers Used for Preparation of Copolymer | Amounts Added (% by weight) of Monomers |
|---|---|---|
| | styrene | 20 |
| Compound 8 | glycidyl methacrylate | 60 |
| | ethyl acrylate | 25 |
| | butyl acrylate | 15 |
| Comparative Compound 1 | glycidyl methacrylate | 10 |
| | ethyl acrylate | 30 |
| | vinylidene chloride | 60 |
| Comparative Compound 2 | glycidyl methacrylate | 30 |
| | ethyl acrylate | 70 |
| Comparative Compound 3 | glycidyl methacrylate | 80 |
| | ethyl acrylate | 20 |

PREPARATION EXAMPLE 2

Preparation of Comparative Compound No. 4 [Vinylidene Chloride-Ethyl Acrylate-Acrylic Acid Copolymer (Aqueous Dispersion)]

The same reaction vessel as used in Example 1 was charged with 200 ml of degasified distilled water and 1 g of sodium dodecylbenzenesulfonate as an emulsifying dispersant. The mixture was heated so that the inside temperature was adjusted to 45° C., and agitation was continued at a rate of 150 rotations per minute. 0.3 g of ammonium persulfate as a polymerization initiator and 0.15 g of acidic sodium sulfite as a polymerization promotor were added to the charge of the reaction vessel, and a monomer mixture of 65 g of vinylidene chloride, 35 g of ethyl acrylate and 5 g of acrylic acid was added dropwise at a constant rate over a period of 2 hours from the dropping funnel. Since generation of polymerization heat was vigorous during the dropwise addition of the monomers, cooling was conducted to moderate boiling of the monomers. After completion of the dropwise addition of the monomers, the reaction was carried out at an inside temperature of 45° C. for 1 hour and then at an inside temperature of 70° C. for 1 hour to thereby complete the polymerization substantially. The so-obtained copolymer (aqueous dispersion) had a solid content of 33% by weight. The degree of polymerization was 99% and the particle size was 0.15μ. The copolymer dispersion had a pH of 2, and the pH was adjusted to 7 by addition of a small amount of 1 N aqueous ammonia when the copolymer dispersion was actually used.

The copolymer dispersion after the pH adjustment had a surface tension of 48 dyne/cm as measured at 25° C.

PREPARATION EXAMPLE 3

Preparation of Comparative Compound No. 5 [Butadiene-Styrene-Itaconic Acid Copolymer (Aqueous Dispersion)]

A starting mixture comprising the following composition was charged and completely sealed in a 100 ml-capacity pressure-resistant ampoule for polymerization, and the ampoule was placed in a shaking type thermostat tank adjusted so that the temperature was maintained at 60° C. Shaking was conducted at a rate of 100 reciprocations per minute, and in this state, the polymerization was conducted for 5 hours to obtain a copolymer (aqueous dispersion) having a solid content of 32% by weight. The degree of polymerization was 95% and the particle size was 0.11μ.

| | |
|---|---|
| Distilled water | 50 ml |
| Sodium-dodecyl benzene sulfonate | 0.25 g |
| Ammonium persulfate | 0.20 g |
| Butadiene | 10 g |
| Stylene | 15 g |
| Itaconic acid | 1 g |

A very small amount of an agglomerate was found to adhere on the wall of the ampoule, but the amount could be neglected. The pH of the dispersion was 2.1 just after it had been withdrawn from the ampoule but the pH was adjusted to 7 by addition of a small amount of 1 N aqueous ammonia. After the pH adjustment, the dispersion had a surface tension of 48 dyne/cm.

Prior to the undercoating treatment with the aqueous copolymer dispersion of this invention, a polyester film is rendered hydrophilic by electronic shock such as corona discharge, ultraviolet irradiation using a low pressure, medium pressure or high pressure mercury lamp or flame treatment, so that the surface of the polyester film has a contact angle below 58° with respect to water. Then, a copolymer of this invention prepared in the form of an aqueous dispersion according to, for example, the process disclosed in Preparation Example 1 is coated on the so treated polyester film, as it is or after it has been mixed, if desired, with various additives such as a diluent, an organic solvent, a plasticizer, a water-soluble polymer, an adhesion promotor, a surface active agent, a blocking-preventing agent, a halation-preventing dye, a film base-coloring dye or pigment and the like. Such additives to be incorporated in the undercoating liquid will now be described. As a drying-promoting solvent, there can be employed, for example, methyl alcohol, ethyl alcohol and acetone, and as a solvent for improving the undercoating film-forming property, there can be employed, for example, methylethyl ketone, dioxane and ethyl acetate. As a so-called temporary plasticizer capable of permeating into particles of the aqueous copolymer dispersion to pasticize the copolymer, thus enhancing melt adhesion among the copolymer particles in the copolymer aqueous dispersion to improve the film-forming property and being evaporated and removed at the subsequent drying or heating step, there can be employed high-boiling-point solvents such as cyclohexanone, butyl cellosolve and benzyl alcohols. Ordinary plasticizers, for example, dibutyl phthalate and dioctyl phthalate can also be used. A water-soluble polymer such as polyvinyl alcohol, carboxymethyl cellulose, a vinyl butyrate-maleic acid copolymer and a gelatin, is used for attaining a good finish on the film formed by coating the undercoating liquid. As an adhesion promotor, there can be employed, for example, a compound containing an ethylene-imino group and a compound containing a methylsulfonyloxy group. As a surface active agent for improving the coating adaptability of the undercoating liquid, there can be employed, for example, anionic surface active agents such as sodium dodecylbenzenesulfonate and sodium laurylsulfate, non-ionic surface active agents such as sorbitan alkyl esters and polyoxyethylene alkyl ethers, mixtures of such anionic surface active agents and non-ionic surface active agents, and natural surface active agents such as saponin.

The amount of the surface active agent is mainly determined based on the amount of the surface active agent added when the copolymer contained in the aqueous polymer dispersion of this invention is prepared, but the solvent may further be added appropriately at the undercoating step so as to improve the coating adaptability of the dispersion.

As a blocking-preventing agent, there can be employed a finely divided material composed of, for example, silicon oxide, titanium oxide, zinc oxide, aluminum oxide, polymethyl methacrylate, polystyrene or starch.

Coating of the aqueous copolymer dispersion of this invention as an undercoating liquid can be accomplished by various methods, such as dip coating, double-roll coating, blade coating, air knife coating, kiss roll coating and gravure roll coating methods. The resulting undercoat is dried by heating it at 60° to 150° C. by parallel or vertical streams of hot air or infrared rays. The aqueous copolymer dipersion of this invention is applied to the surface of the polyester film in such an amount that the dried undercoating layer has a thickness corresponding to a unit weight of 0.05 to 5 g/m$^2$.

The resulting supporting film obtained by coating and drying the aqueous copolymer dispersion of this invention as the undercoating liquid on the polyester film may be heat-treated at 100° to 180° C. according to need. A hydrophilic polymeric layer or gelatin layer may be coated in an amount of 0.05 to 5 g/m$^2$ as a secondary undercoating layer on the above undercoating according to techings of Japanese Patent Publication No. 24159/71, Japanese Patent Application Laid-Open Specification No. 91165/73 or Japanese Patent Publication No. 23828/74. It is also possible to heat-treat the support at 100° to 180° C. after formation of such secondary undercoating layer.

In this case, in order to improve the blocking-preventing property, the adhesion and the antistatic property, additives such as mentioned above with respect to the first undercoating layer, for example, an ethylene imino group-containing compound, a methylsulfonyloxy group-containing compound, and finely divided titanium oxide, silicon oxide, zinc oxide, aluminum oxide, polymethyl methacrylate, polystyrene or starch, may be incorporated into the secondary undercoating liquid.

Various photographic light-sensitive layer-forming compositions such as a silver halide photographic emulsion, a diazo-type photosensitive composition, a gelatin composition containing a halation-preventing agent and a gelatin packing composition for adjusting the curl balance of the supporting film may be coated on the supporting film on which the undercoating layer has been formed in the above-mentioned manner. Application of these photographic compositions may be accomplished by any of customary methods. The resulting photographic light-sensitive material is excellent in the adhesion and the photographic light-sensitive layer is not peeled from the supporting film even if the material is subjected to photographic treatments such as development. Especially in the case of the silver halide photographic light-sensitive material, even if the development treatment is carried out by using an automatic developer, no edge peeling is caused. Further, the undercoating layer formed by the aqueous copolymer dispersion of this invention has no bad influence on the photographic characteristics of the silver halide photographic material.

This invention will now be illustrated in more detail by reference to the following Examples that do not limit the scope or embodiments of this invention.

EXAMPLE 1

A biaxially stretched polyethylene terephthalate film having a thickness of 180μ was subjected to the surface treatment using a corona discharge device (Model HFSG-2 from Lebel Co.) under discharge conditions: a film running speed of 15 m/min, an electrode spacing of 1.5 mm, an electric power of 200 W and an electric current of 0.7 ampere. The contact angle of the so treated surface of the polyethylene terephthalate film with water was found to be 45°.

Compounds 2, 3 or 4 illustrated before was diluted with water so that the solid content was reduced to 25% by weight. Then, saponin in an amount of 20% by weight based on the solids and 1,3-dimethylsulfoxypropane in an amount of 3% by weight based on the solids were incorporated into the dilution. The so obtained aqueous copolymer dispersion of this invention was found to have a surface tension of 45 to 50 dyne/cm. The dispersion was then coated on the treated surface of the above polyethylene terephthalate film by a double-roll coater and then dried for 3 minutes in hot air heated at 120° C. The thickness of the dried undercoating layer was found to be 0.4 to 0.5 g/m$^2$.

A silver halide photographic emulsion for X-ray photography was coated on the undercoating of each of the so obtained three polyethylene terephthalate film supports to obtain samples 1, 2 and 3.

Comparative samples (samples 4 and 5) were prepared in the same manner as described above except that comparative compounds 1 and 2 illustrated before were employed.

These samples including comparative samples were subjected to film adhesion tests and edge peeling tests according to the following methods (a), (b), (c) and (d). Further, the undercoatings of the samples before coating of the silver halide emulsion were subjected to blocking tests according to the following method (e). The results of these tests are shown in Table 2 disclosed later.

(a) Adhesion test of dry film before treatment

The silver halide emulsion layer of the sample was cut by a razor in a depth reaching the film support to form square scars on the sample. A cellophane adhesive tape was applied under pressure on the scarred surface of the sample, and the tape was abruptly peeled off. The adhesion was evaluated based on the ratio (%) of the area of the emulsion film left on the support to the total tape-applied area.

(b) Adhesion test of wet and swollen film during development

The silver halide emulsion layer of the sample in the wet and swollen state during the development treatment was scarred by a metal rod having a sharp end resembling that of an auger to form square scars on the sample, and the scarred surface was rubbed. The adhesion was evaluated based on the ratio (%) of the area of the emulsion film left on the support to the total area rubbed.

(c) Adhesion test of dry film after treatment

The sample was treated with a developer and a fixing agent, and washed with water and dried. Then, the sample was subjected to the film adhesion test according to the above method (a). The adhesion was evaluated based on the ratio (%) of the emulsion film left on the support.

(d) Edge peel test during treatment

The sample which was being treated with a developer and a fixing agent and in the wet and swollen state was rubbed strongly with a finger or soft rubber from the photosensitive layer edge toward the interior in a horizontal direction rectangular to the edge. When the photosensitive layer was peeled even only a bit, the edge peel resistance was evaluated as "bad" and when the photosensitive layer was not peeled at all, the edge peel resistance was evaluated as "good".

(e) Blocking test

The blocking resistance was evaluated as "bad" when the undercoated film support was wound and wrinkles were formed on the film support by the blocking phenomenon. If no wrinkle was formed, the blocking resistance was evaluated as "good".

EXAMPLE 2

The surface of a biaxially stretched polyethylene terephthalate film having a thickness of 100μ was irradiated for 15 minutes by a 400-watt low pressure mercury lamp having a main wave length of 2537 Å by adjusting the distance between the light source and the film surface to 2 cm. The irradiation atmosphere is of a temperature of 25° C. and a relative humidity of 55%. The surface of the polyethylene terephthalate film treated under the above conditions had a contact angle of 55° with water.

Each of compounds 1, 5 or 7 illustrated before was diluted with water so that the solid content was reduced to 10% by weight, to thereby prepare an aqueous copolymer dispersion of this invention. The dispersion was coated as an undercoating liquid on the surface of the polyethylene terephthalate film which had been subjected to the above hydrophilic treatment, by using an air knife coater, and then the coating was dried for 2 minutes in hot air heated at 85° to 90° C. The thickness of the resulting dry coating layer was found to be 0.8 to 1.0 g/m$^2$. A secondary undercoating solution obtained by adding 3% by weight, based on gelatin, of saponin to an aqueous solution containing 1.0% by weight of gelatin was coated by an air knife coater and dried for 2 minutes in hot air maintained at 85° to 90° C. The thickness of the dry gelatin coating was found to be 0.2 to 0.25 g/m$^2$. Then, the coated film was heat-treated for 1 minute by using a hot roller, the surface of which was maintained at 150° C. A silver halide photographic emulsion for lith-photography containing silver chlorobromide was coated on the undercoating layer. Thus, samples 6, 7 and 9 were prepared. Separately, comparative samples (samples 9 and 10) were prepared in the same manner as described above by using comparative compounds 2 and 5 illustrated before.

These samples and comparative samples were subjected to the film adhesion test and the edge peeling test according to the methods described in Example 1. Further, the undercoatings of the samples and comparative samples before application of the silver halide emulsion were subjected to the blocking test according to the method described in Example 1. The results are shown in Table 2 set forth later.

EXAMPLE 3

The surface of a biaxially stretched polyethylene terephthalate film having a thickness of 180μ was subjected to the hydrophilic treatment in the same manner as described in Example 1. An undercoating liquid formed by diluting each of compounds 1, 4 or 8 illustrated before with a diluent comprising 70% by volume of water and 30% by volume of methyl alcohol so that the solid content was reduced to 25% by weight was coated on the surface of the so treated film, and the undercoating was heated for 2 minutes in hot air heated at 85° to 90° C. The thickness of the dry undercoating layer was found to be about 0.4 to about 0.5 g/m$^2$. Then, an aqueous solution containing 0.5% by weight of a compound prepared according to the method disclosed in Synthesis Example 1 of U.S. Pat. No. 3,573,093 was coated on the above undercoating layer by a double-roll coater and dried for 1 minute in hot air heated at 85° to 90° C. The thickness of the so obtained dry coating layer was found to be about 0.1 g/m$^2$.

Then, the undercoated polyethylene terephthalate film was heat-treated for 5 minutes in hot air maintained at 130° C., and a silver halide photographic emulsion for X-ray photography was coated and dried on the undercoated surface of the film. Thus, there were prepared samples 11, 12 and 13.

Comparative samples (samples 14 and 15) were prepared in the same manner as described above except that comparative compounds 3 and 4 illustrated before were used.

These samples and comparative samples were subjected to the film adhesion test and the edge peeling test according to the methods described in Example 1. Further, undercoatings of the samples and comparative samples before application of the silver halide emulsion were subjected to the blocking test according to the method described in Example 1. Test results are shown in Table 2 set forth later.

EXAMPLE 4

The surface of a biaxially stretched polyethylene terephthalate film having a thickness of 100μ was subjected to the hydrophilic treatment according to the method described in Example 1. A dispersion formed by diluting the aqueous copolymer dispersions 4, 5 or 6 illustrated before with water so that the solid content was reduced to 5% by weight and adding thereto 1.0% by weight, based on the solids, of saponin, 5.0% by weight, based on the solids, of hexamethylene-bis(N,N-ethyleneurea) and 0.01% by weight, based on the solids, of silicon oxide having a particle size of 3 to 5μ was coated as an undercoating liquid on the surface of the treated film by using a double-roll coater, and the undercoating was dried for 30 seconds in hot air heated at 120° C. The thickness of the dry undercoating layer was found to be about 0.55 to about 0.75 g/m$^2$. A secondary undercoating liquid composed of a gelatin composition comprising 2.0 g of gelatin and 90 ml of water was coated on the above undercoating layer by a double-roller coater and dried for 30 seconds in hot air maintained at 120° C. The thickness of the resulting dry coating layer was found to be about 0.6 to 0.7 g/m$^2$.

A dye-containing gelatin composition was then coated and dried as a halation-preventing layer for a silver halide photographic light-sensitive material for lith-photography on the so obtained undercoating layer. Thus, there were prepared samples 16, 17 and 18.

Separately, comparative samples (samples 19 and 20) were prepared in the same manner as described above except that comparative compounds 2 and 5 illustrated before were employed.

These samples and comparative samples were subjected to the film adhesion test and the edge peeling test according to the methods described in Example 1. Further, the undercoatings of the samples and comparative samples before formation of the halation preventing layer were subjected to the blocking test according to the method described in Example 1. Test results are shown in Table 2 disclosed below.

TABLE 2

| Sample No. | Copolymer Contained in Undercoating Liquid (aqueous dispersion) | Blocking Resistance | Edge Peel Resistance | Emulsion Layer Adhesion (%) dry film before treatment | wet and swollen film during treatment | dry film after treatment |
|---|---|---|---|---|---|---|
| Example 1 | | | | | | |
| 1 (this invention) | compound 2 | good | good | 95 | 100 | 90 |
| 2 (this invention) | compound 3 | good | good | 95 | 100 | 100 |
| 3 (this invention) | compound 4 | good | good | 100 | 100 | 100 |
| 4 (comparison) | comparative compound 1 | good | bad | 50 | 100 | 30 |
| 5 (comparison) | comparative compound 4 | good | bad | 0 | 50 | 0 |
| Example 2 | | | | | | |
| 6 (this invention) | compound 1 | good | good | 95 | 100 | 80 |
| 7 (this invention) | compound 5 | good | good | 100 | 100 | 100 |
| 8 (this invention) | compound 7 | good | good | 80 | 100 | 100 |
| 9 (comparison) | comparative compound 2 | bad | good | 90 | 100 | 100 |
| 10 (comparison) | comparative compound 5 | good | bad | 100 | 0 | 100 |
| Example 3 | | | | | | |
| 11 (this invention) | compound 1 | good | good | 95 | 80 | 90 |
| 12 (this invention) | compound 4 | good | good | 100 | 100 | 100 |
| 13 (this invention) | compound 8 | good | good | 80 | 90 | 90 |
| 14 (comparison) | comparative compound 3 | good | good | 20 | 100 | 0 |
| 15 (comparison) | comparative compound 4 | good | bad | 0 | 0 | 0 |

TABLE 2-continued

| Sample No. | Copolymer Contained in Undercoating Liquid (aqueous dispersion) | Blocking Resistance | Edge Peel Resistance | Emulsion Layer Adhesion (%) dry film before treatment | wet and swollen film during treatment | dry film after treatment |
|---|---|---|---|---|---|---|
| Example 4 | | | | | | |
| 16 (this invention) | compound 4 | good | good | 90 | 100 | 100 |
| 17 (this invention) | compound 5 | good | good | 100 | 100 | 100 |
| 18 (this invention) | compound 6 | good | good | 100 | 100 | 100 |
| 19 (comparison) | comparative compound 2 | bad | good | 80 | 100 | 80 |
| 20 (comparison) | comparative compound 5 | good | bad | 50 | 100 | 30 |

Form the results shown in Table 2, it will readily be understood that polyethylene terephthalate film supports undercoated with aqueous copolymer dispersions of this invention are suprior to polyethylene terephthalate film supports undercoated with comparative aqueous copolymer dispersions so that the edge peel trouble is not caused at all and further with respect to properties of undercoating layers such as the adhesion and anti-blocking properties.

As regards the adhesion, it has been confirmed that if film supports have an adhesion value of 70% or more as measured according to the above-mentioned emulsion layer adhesion test, the film supports can be practically used satisfactorily.

EXAMPLE 5

A diazonium light-sensitive liquid having the following composition was coated in an amount of 50 ml/m$^2$ on the undercoated surface of each of the samples and comparative samples undercoated in Example 1 to prepare samples of this invention (samples 21, 22 and 23) and comparative samples (samples 24 and 25).

| Diazonium Light-Sensitive Liquid | |
|---|---|
| 2,5-diethoxy-4-morpholinobenzene diazonium tetrafluoroborate | 1.0 g |
| 2-hydroxy-3-naphthoic acid 2'-methylanilide | 1.5 g |
| cellulose acetate butyrate | 5.0 g |
| sulfosalicylic acid | 0.5 g |
| citric acid | 0.5 g |
| zinc chloride | 0.2 g |
| ethylene chloride | 60 ml |
| ethyl alcohol | 30 ml |
| dioxane | 10 ml |

These samples and comparative samples were subjected to the adhesion test before the treatment and the adhesion test after the treatment according to the methods (a) and (c) described in Example 1 to obtain results shown in Table 3.

TABLE 3

| Sample No. | Copolymer Contained in Undercoating Liquid (aqueous dispersion) | Layer Adhesion (%) dry film before treatment | dry film after treatment |
|---|---|---|---|
| 21 (this invention) | compound 2 | 75 | 75 |
| 22 (this invention) | compound 3 | 95 | 90 |
| 23 (this invention) | compound 4 | 100 | 90 |
| 24 (comparison) | comparative compound 1 | 30 | 30 |
| 25 (comparison) | comparative compound 4 | 0 | 0 |

From the results shown in Table 3, it will readily be understood that undercoating layers formed by using aqueous copolymer dispersions of this invention have a very excellent adhesion to diazonium photosensitive layers, and that this excellent adhesion can be retained even after the color development treatment.

What is claimed is:

1. A method of coating a polyester film of a light-sensitive photographic material comprising (a) treating a side of said film by the method selected from the group consisting of corona discharge, ultraviolet irradiation, or flame treatment whereby the contact angle between said side and water is below 58°, (b) applying to said treated side a layer of an aqueous dispersion containing no organic solvent acting as a solvent or swelling agent, said dispersion containing a copolymer having, as repeating units, 20 to 60% by weight of glycidyl methacrylate and 25 to 60% by weight of ethylacrylate, the sum of said glycidyl methacrylate and said ethyl methacrylate, being at least 76% by weight based on the weight of said copolymer whereby a coated side is formed, and (c) subjecting said coated side to a temperature of between 60° C. and 150° C. whereby said coated side is dried and said layer has a weight of 0.05 to 5.0 g/m$^2$, and (d) applying to said dried coated side a silver halide emulsion layer.

2. The method according to claim 1 wherein the amount by weight of ethyl acrylate is greater than the amount by weight of glycidyl methacrylate and said copolymer further comprises, as additional repeating units, at lesat one monomer capable of increasing the glass transition temperature of said copolymer.

3. The method according to claim 1 wherein said monomer is selected from the group consisting of vinylidene chloride, styrene, methyl methacrylate, ethyl methacrylate, butyl methacrylate, vinyl acetate, acrylonitrile, and diacetone acrylamide.

4. The method according to claim 1 wherein the amount by weight of ethyl acrylate is less than the amount by weight of glycidyl methacrylate and said copolymer further comprises, as additional repeating units, at least one monomer capable of reducing the glass transition temperature of said copolymer.

5. The method according to claim 1 wherein said copolymer further comprises, as additional repeating units, up to 5% by weight of at least one monomer selected from the group consisting of acrylic acid, methacrylic acid, itaconic acid, 2-sulfoethyl methacrylate, and 2-sulfopropyl methacrylate.

6. The method of claim 1 wherein said material is a silver halide light-sensitive photographic material.

7. The method according to claim 4 wherein the monomer is selected from the group consisting of butyl acrylate, 2-ethylhexyl acrylate, isoprene and butadiene.

* * * * *